United States Patent [19]

Kaplan

[11] Patent Number: 4,856,772

[45] Date of Patent: Aug. 15, 1989

[54] WRIST AND GRIPPING MUSCLE EXERCISING APPARATUS

[76] Inventor: Hal L. Kaplan, 415 College Pkwy., Rockville, Md. 20850

[21] Appl. No.: 172,292

[22] Filed: Mar. 23, 1988

[51] Int. Cl.[4] ..... A63B 21/06

[52] U.S. Cl. ..... 272/67; 272/118

[58] Field of Search ..... 272/67, 68, 117, 118, 272/134, 143

[56] References Cited

U.S. PATENT DOCUMENTS

| | | | |
|---|---|---|---|
| 2,263,135 | 11/1941 | Johnson | 272/68 |
| 3,635,472 | 1/1972 | Marcyan | 272/118 |
| 3,820,782 | 6/1974 | Salkeld | 272/118 |
| 4,226,412 | 10/1980 | Panepinto | 272/68 |
| 4,349,192 | 9/1982 | Lambert, Jr. et al. | 272/118 |
| 4,373,717 | 2/1983 | Lambert, Jr. | 272/67 |
| 4,411,424 | 10/1983 | Barnot | 272/118 |
| 4,553,746 | 11/1985 | Lee | 272/68 |

FOREIGN PATENT DOCUMENTS

| | | | |
|---|---|---|---|
| 23472 | of 1912 | United Kingdom | 272/68 |

*Primary Examiner*—Richard J. Apley
*Assistant Examiner*—Robert W. Bahr
*Attorney, Agent, or Firm*—Richard C. Litman

[57] ABSTRACT

Exercising apparatus for the gripping and wrist muscles including weights and a pulley system threaded with lines to support the weights and so tensioned bias a finger grip which is restrained for translationally rectilinear motion. There are two embodiments of the hand grasping mechanism containing finger grips. One embodiment uses principally rolling bearings to ensure translational motion of the finger grip and the other use a slide and a rolling bearing combined at the top and bottom respectively of the finger grip.

3 Claims, 2 Drawing Sheets

WRIST AND GRIPPING MUSCLE EXERCISING APPARATUS

BACKGROUND OF THE INVENTION

1. Field of the Invention

Today the expanding interest of exercise for health has prompted many devices to exercise various parts of the body. These devices include springs, weights, and frictional and hydraulic and pneumatic type devices. Such mechanisms may also be used for therapy. The present device will exercise the gripping and wrist muscles.

2. Description of Related Art

U.S. Pat. No. 3,807,729 to K. Sigma is drawn to a spring resistance hand muscle exercising device with a counter for indication of the number of times the device and muscles are flexed.

U.S. Pat. No. 4,222,412 to L. Panepinto is another spring resistance hand-held exercise device.

U.S. Pat. No. 4,553,746 to V. H. Lee is similarly a spring resistance hand-held device hit with indicators for spring forcefulness and the number of times flexed.

U.S. Pat. No. 4,222,560 to E. O. Hallerman is a pressure type device with a resilient chamber filled with liquid. Squeezing the chamber results in liquid being displaced into an upper chamber formed as a bellows. Progressive filling of the bellows indicates progress to the user.

U.S. Pat. No. 3,653,659 to H. Zinkin is drawn to a wrist exerciser using friction for alternately exercising one wrist and then the other.

U.S. Pat. No. 4,068,843 to D. L. Frost is drawn to a table-mounted pivotally hinged arm simulating an arm wrestling opponent's arm, resistance being adjustably provided by a guided counterweight beneath the table connected by a cable over a pulley above one end of the table to the free end of the hinged arm.

U.S. Pat. No. 2,814,491 to A. C. Proctor is drawn to a translating grip exercising device using pulleys and weight with connections by lines to both end portions of a finger grip. This device is the most similar in operation to the apparatus of the present invention.

SUMMARY OF THE INVENTION

The invention is drawn to an exercise device designed to work the gripping and wrist muscles by a person situated in front of the apparatus and flexing his hands on two grasping mechanisms simultaneously. Each grasping mechanism includes a finger grip for four fingers and a thumb-palm grip for the fifth finger. The finger grip is held vertically and has not rotational motion being restrained in its supporting structure and bearings to move only in translationally rectilinear motion. The finger grips are biased by lines tensioned on a pulley system by suspended weights. The moments due to the grasp of the hand and the tension of the lines is countered in the bearings which allow rectilinear motion only. There is a slide in a slot and a wheeled hearing at either end, top and bottom respectively, of the finger grip. The device is simple; easy to manufacture and maintain.

DETAILED DESCRIPTION OF THE PREFERRED EMBODIMENT

Figure 1:
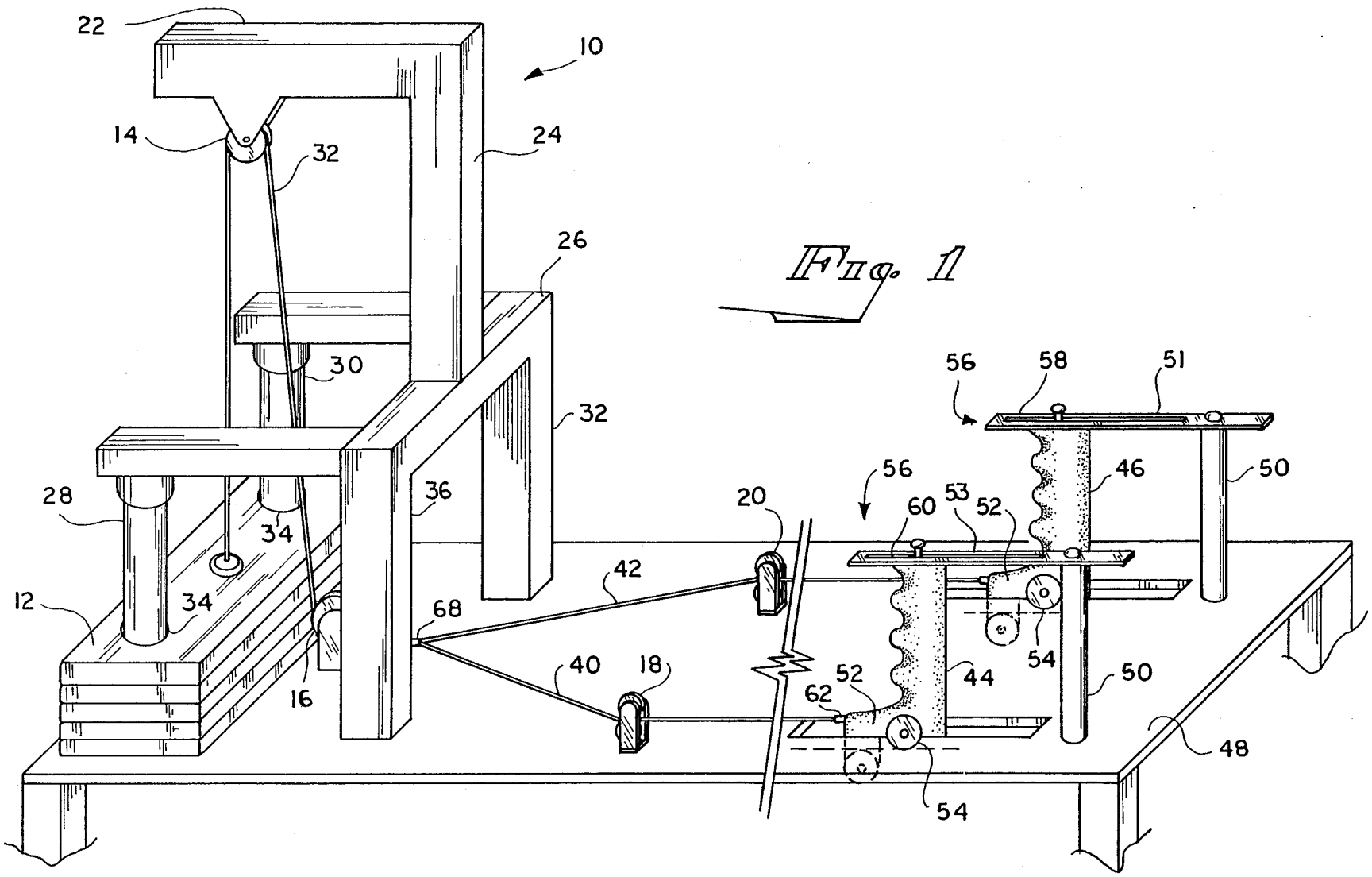
FIG. 1 is a perspective view of one embodiment of the invention describing the weight and pulley system of this and a second embodiment and a first grasping mechanism.

The wrist and gripping muscle exercise apparatus 10 includes some tensioning weights 12 lifted by lines 38, 40 and 42 threaded about a pulley system including pulleys 14, 16, 18 and 20. Pulley 14 is supported on cantilever 22 extending from columnar support 24 which is turn supported by brace 26 standing secured to a stationary platform or frame 48. The brace 26 includes four legs 28, 30, 32 and 36. Two of these legs 28 and 30 extend down through alignment holes 34 in the weights 12 and serve to keep the suspended weights 12 from rotating in either a vertical plane or a horizontal plane. Pulley 14 is for exerting a vertical force. Pulley 16 allows tension on the line 38 to be exerted horizontally. Line 38 branches out into two cooperating lines 40 and 42 at oblique angles to the horizontal portion 68 of line 38. Pulleys 18 and 20 direct the branched lines 40 and 42 to the grasping devices 56 and the branches 40 and 42 bias the finger grips 44 and 46 with the tension fostered by the suspended weights 12.

The finger grips 44 and 46 are each restrained to the translationally rectilinear motions by the various couples exerted by the supporting frame 48 and confining elements 51, 52, and 53. The confining elements comprising slides 51, 53 and levers 52. Sliding grips 44 and 46 slide using slots 58 and 69 of the respective slides 51 and 53.

Figure 3:
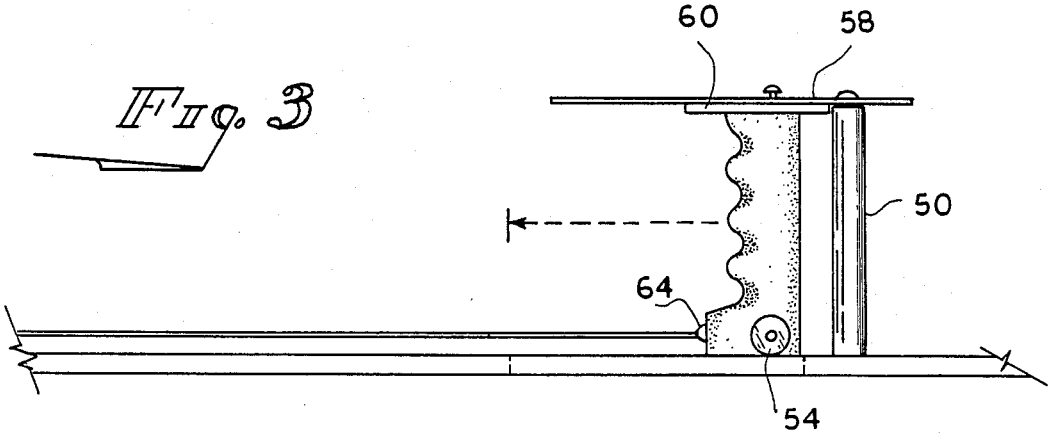
FIG. 3 is a second embodiment of the finger grip balancing the torques with a slotted slide without the underside bearing.

Lines 40 and 42 are connected to the finger grips 44 and 46 at 62 to lever 52 in FIG. 1 and at 64 to the finger grips 44 and 46 in FIG. 3. In FIG. 3 the finger grips are preferably fitted with a horizontal plate 60 for exerting the necessary couple component to offset the moment caused at the conection 64 and the hand grasping at finger grips 44 and 46.

Figure 2:
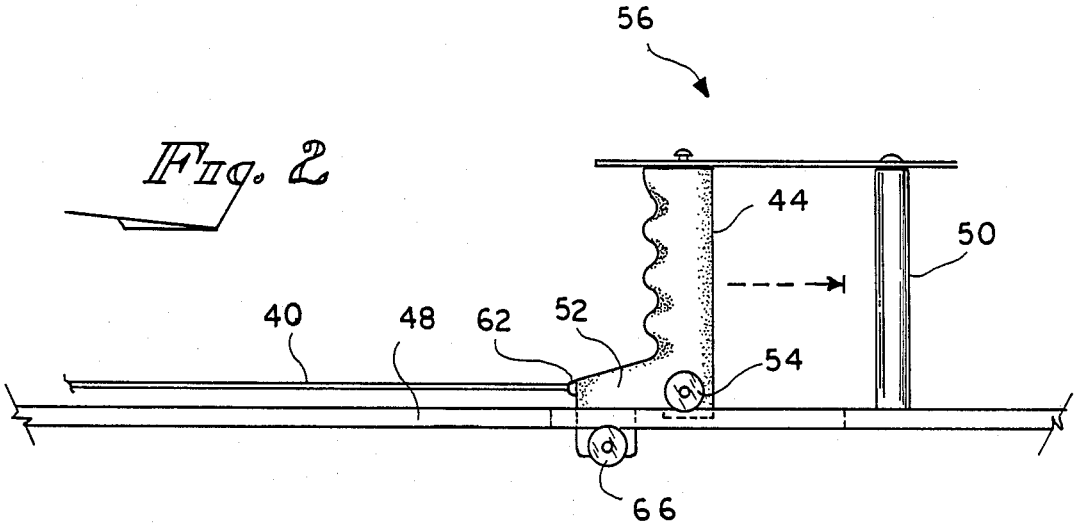
FIG. 2 is a view under the frame of bearing means used in cooperation with the wheeled bearing topside of the frame to counteract moments caused by the hand on the finger grip and the tension on the line.

In FIG. 2 the grasping devices 56 includes roller means, consisting of a wheel 66 shown in FIG. 2 below frame 48 and a wheel above frame 48 to exert counter moment to the hand grasping on the finger grip 44 and duplicated but not shown in FIG. 2 at 46 and also the tension on line 40 and also duplicated at 42 but not shown in FIG. 2.

I claim:

1. An exercise apparatus for simultaneously exercising both the wrist and gripping muscles comprising:

a horizontal support platform;

grasping means including right and left vertical thumb grips rigidly affixed to said platform, and right and left vertical finger grips slidably attached to said support platform, each of said grasping means having upper and lower portions;

confining means joining the upper portions of each said right and left finger grips to each said right and left thumb grips respectively, and said support platform having slots confining the lower portions of said right and left finger grips, said confining means and said slots cooperating to retain each respective said right and said left finger and thumb grips in a horizontally coplanar orientation; and, biasing means including weights, lines and at least four pulleys, said lines secured at one end to said right and left finger grips respectively and at a second end to said weights, and said four pulleys including pulleys affixed to said support platform and aligned with said right and left thumb and finger grips respectively, whereby a user may exercise their hands individually or concurrently against the resistance of said weights, said weights normally providing a constant tension on the line and applying a resistance to movement of both said right and left finger grips toward said thumb grip.

2. The exercise apparatus of claim 1 further comprising antifriction roller means on said finger grips, said roller means including a pair of offset wheels respectively above and below said platform for maintaining said finger grips in a substantially vertical position during the operation of said apparatus.

3. The exercise apparatus of claim 1 wherein said lines include separate lines adjoined to said right and left finger grips respectively, said separate lines merging intermediate said finger grips and said weights such that a single line is secured to said weights.

* * * * *